US009158246B2

(12) United States Patent
Katakura

(10) Patent No.: US 9,158,246 B2
(45) Date of Patent: Oct. 13, 2015

(54) IMAGE FORMING APPARATUS HAVING MULTIPLE MEDIUM PATHS TO A FIXING UNIT

(71) Applicants: KABUSHIKI KAISHA TOSHIBA, Tokyo (JP); TOSHIBA TEC KABUSHIKI KAISHA, Tokyo (JP)

(72) Inventor: Hiroshi Katakura, Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/183,186

(22) Filed: Feb. 18, 2014

(65) Prior Publication Data

US 2015/0071668 A1 Mar. 12, 2015

(30) Foreign Application Priority Data

Sep. 12, 2013 (JP) ..... 2013-189124

(51) Int. Cl.
*G03G 15/20* (2006.01)

(52) U.S. Cl.
CPC .. *G03G 15/2046* (2013.01); *G03G 2215/00244* (2013.01); *G03G 2215/00392* (2013.01)

(58) Field of Classification Search
CPC ..... G03G 9/0928; G03G 21/00; G03G 2215/00421; G03G 15/6502; G03G 15/6573; G03G 15/6558; G03G 15/657; B41J 2/335
See application file for complete search history.

(56) References Cited

U.S. PATENT DOCUMENTS

| | | | | |
|---|---|---|---|---|
| 5,781,822 | A * | 7/1998 | Nishiyama et al. | 399/1 |
| 6,577,827 | B2 * | 6/2003 | Matsuura et al. | 399/45 |
| 6,801,175 | B2 * | 10/2004 | Miyamoto et al. | 345/84 |
| 8,615,189 | B2 | 12/2013 | Imamiya et al. | |
| 2011/0222937 | A1 * | 9/2011 | Yahata et al. | 399/341 |
| 2011/0262166 | A1 * | 10/2011 | Imamiya | 399/68 |
| 2011/0262197 | A1 * | 10/2011 | Imamiya et al. | 399/341 |
| 2012/0189340 | A1 * | 7/2012 | Hagiwara | 399/82 |

(Continued)

FOREIGN PATENT DOCUMENTS

| | | | | |
|---|---|---|---|---|
| JP | H08152823 | A | 6/1996 | |
| JP | H11249511 | * | 9/1999 | G03G 21/00 |

(Continued)

OTHER PUBLICATIONS

Japanese Office Action dated Dec. 16, 2014, filed in Japanese counterpart Application No. 2013-189124, 9 pages (with translation).

*Primary Examiner* — Clayton E Laballe
*Assistant Examiner* — Ruifeng Pu
(74) *Attorney, Agent, or Firm* — Patterson & Sheridan, LLP

(57) ABSTRACT

An image forming apparatus includes an image forming unit configured to form an image on a first medium at an image forming position, a fixing unit configured to fix the image formed on the first medium by heating the first medium at a first temperature, a conveying unit configured to convey the first medium to the fixing unit through a first path extending from the image forming position to the fixing unit and convey a second medium to the fixing unit through a second path that merges with the first path at a position between the image forming position and the fixing unit, and a control unit configured to control the fixing unit to be a second temperature that is higher than the first temperature, when the control unit determines that the conveying unit is conveying the second medium to the fixing unit through the second path.

16 Claims, 11 Drawing Sheets

(56) References Cited

U.S. PATENT DOCUMENTS

| | | | | |
|---|---|---|---|---|
| 2013/0273464 | A1* | 10/2013 | Kashiwagi | 430/30 |
| 2014/0055546 | A1* | 2/2014 | Imamiya | 347/179 |
| 2014/0255055 | A1* | 9/2014 | Katayama | 399/69 |

FOREIGN PATENT DOCUMENTS

| | | | |
|---|---|---|---|
| JP | 2010181883 | A | 8/2010 |
| JP | 2010204167 | A | 9/2010 |

* cited by examiner

IMAGE FORMING APPARATUS HAVING MULTIPLE MEDIUM PATHS TO A FIXING UNIT

CROSS-REFERENCE TO RELATED APPLICATION

This application is based upon and claims the benefit of priority from Japanese Patent Application No. 2013-189124, filed Sep. 12, 2013, the entire contents of which are incorporated herein by reference.

FIELD

Embodiments described herein relate to an image forming apparatus having an image forming function and an image erasing function.

BACKGROUND

Conventionally, a technology for printing an image on a sheet with a decolorizable material has been employed. The decolorizable material has, for example, a characteristic of being decolorized when heated at a certain temperature. Therefore, by using such a decolorizable material, a printing operation and an erasing operation can be carried out repeatedly on the same sheet.

DETAILED DESCRIPTION

In accordance with one embodiment, an image forming apparatus includes an image forming unit configured to form an image on a first medium at an image forming position, a fixing unit configured to fix the image formed on the first medium by heating the first medium at a first temperature, a conveying unit configured to convey the first medium to the fixing unit through a first path extending from the image forming position to the fixing unit and convey a second medium to the fixing unit through a second path that merges with the first path at a position between the image forming position and the fixing unit, and a control unit configured to control the fixing unit to be a second temperature that is higher than the first temperature, when the control unit determines that the conveying unit is conveying the second medium to the fixing unit through the second path.

Hereinafter, embodiments are described in detail with reference to accompanying drawings.

(First Embodiment)

Figure 1:
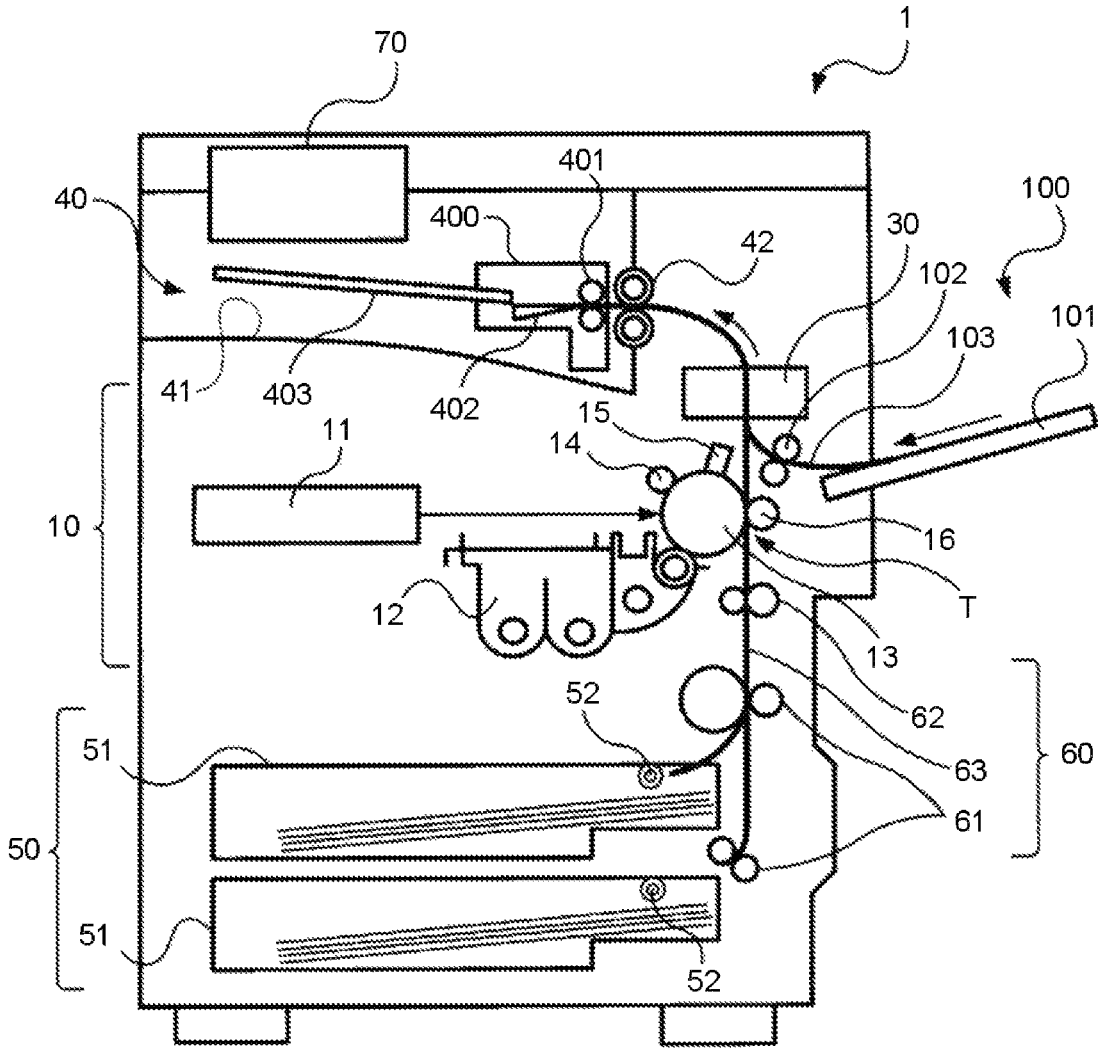
FIG. 1 is a diagram illustrating a schematic configuration of an image forming apparatus according to a first embodiment.

FIG. 1 is a diagram illustrating a schematic configuration of an image forming apparatus 1 according to a first embodiment. Hereinafter, the image forming apparatus 1 in the present embodiment is described as a Multi Function Peripheral (MFP).

The MFP 1 comprises an image forming section 10, a fixing section 30 for heating and pressing a sheet, a paper discharge section 40, a paper feed cassette section 50 for storing a sheet, a first sheet conveyance section 60, an operation section 70, a second sheet conveyance section 100, and a paper discharge tray with separator 400.

The paper feed cassette section 50 has a multistate structure including a plurality of paper feed cassettes 51 arranged one above the other to store sheets. The sheets stored in the paper feed cassettes 51 are conveyed to a sheet conveyance path 63 by a paper feed rollers 52.

The first sheet conveyance section 60 conveys a sheet (a first medium) fed from the paper feed cassette section 50 towards a register roller 62 with a sheet conveyance roller 61, conveys the sheet to a transfer position T of the image forming section 10 at a given timing with the register roller 62, and further conveys the sheet to the paper discharge section 40 via the fixing section 30.

The image forming section 10 includes a laser exposure device 11, a developer 12, a charger 14, a cleaner 15, and a transfer roller 16 around a photoconductive drum 13. The laser exposure device 11 forms an electrostatic latent image on the surface of the photoconductive drum 13 by irradiating the surface of the photoconductive drum 13 with a laser based on, for example, image data of an original read out and stored in a memory section 501 shown in FIG. 2. The electrostatic latent image is developed as a toner image by the developer 12. The developer 12 is capable of storing, for example, a decolorizable toner serving as a decolorizable material. The transfer roller 16 transfers the toner image to a sheet at the transfer position T. The cleaner 15 removes the toner left on the photoconductive drum 13 after the transferring operation. The charger 14 uniformly charges the surface of the photoconductive drum 13.

The decolorizable toner stored in the developer 12 is formed by coating a color material which is decolorized by heating on, for example, a thermoplastic resin base. The decolorizable toner is decolorized when heated above a given decolorizing temperature (T1). Herein, a fixing temperature (T2) at which the decolorizable toner fuses when heated is set to be lower than the decolorizing temperature (T1).

When the MFP 1 is carrying out an image forming processing, the fixing section 30 heats and presses a sheet onto which a toner image has been transferred at a temperature T2 to fix the toner image on the sheet. Further, when the MFP 1 is carrying out an image erasing processing, the fixing section 30 heats and presses a sheet on which an erasable toner image is printed at the temperature T1 to erase the erasable toner image.

The fixing section for fixing a toner image on a sheet generally heats and presses a sheet using a pair of a heating roller and a pressing roller. In the present embodiment, for example, the fixing section 30 can be provided with two pairs of a heating roller and a pressing roller. The two pairs of the heating roller and the pressing roller can be arranged in such a manner that the arrangement direction of the heating roller and the pressing roller in one pair is opposite to that of the heating roller and the pressing roller in the other pair.

The second sheet conveyance section 100 comprises an image-erasable sheet stacking tray 101, an image-erasable sheet conveyance roller 102 and a second sheet conveyance path 103. The distance of the sheet conveying path extending between the image-erasable sheet stacking tray 101 and the fixing section 30 is shorter than the distance of the sheet conveying path extending between the paper feed cassette 51 and the fixing section 30. That is, the second conveying path 103 is shorter than the first conveying path 63. The image-erasable sheet stacking tray 101 stores a sheet (a second medium) to be subjected to the image erasing processing. The second sheet conveyance path 103 merges with the first sheet conveyance path 63 at a position between the fixing section 30 and the transfer position T. The sheet stacked on the image-erasable sheet stacking tray 101 is conveyed to the first sheet conveyance section 63 through the erasing sheet conveyance roller 102, and the sheet on which image is to be erased is conveyed to the fixing section 30.

A paper discharge roller 42 discharges the sheet subjected to the image forming processing or the image erasing processing through the fixing section 30 towards a paper discharge tray 41.

The operation section 70 provided with a monitor carries out various kinds of operations.

Figure 4:
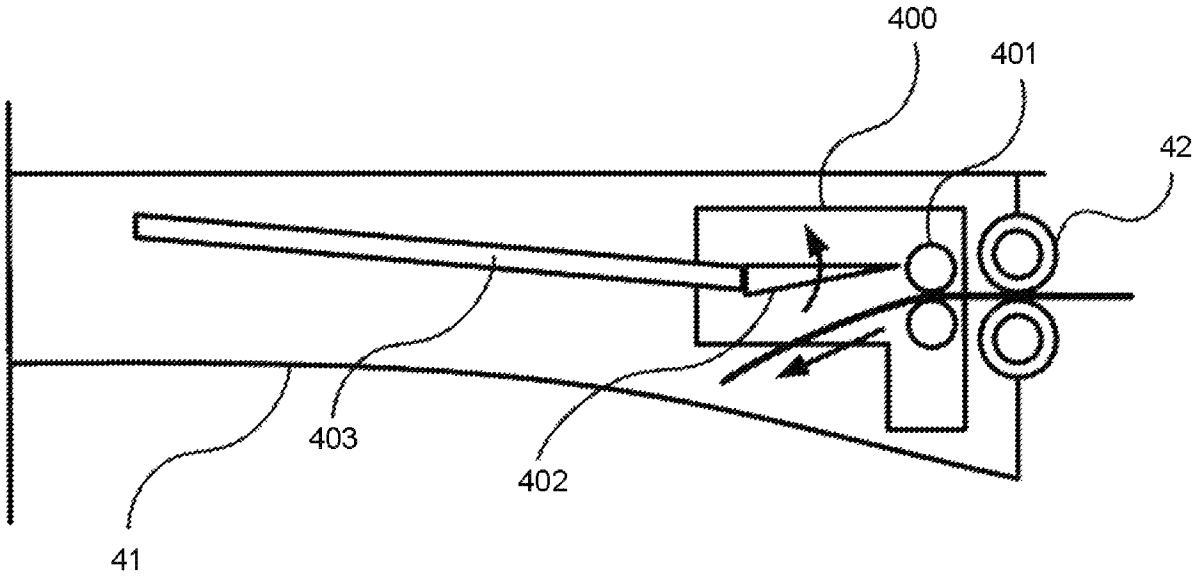
FIG. 4 is a diagram illustrating a state of a separator when a print mode is selected with the operation section shown in FIG. 3.
Figure 5:
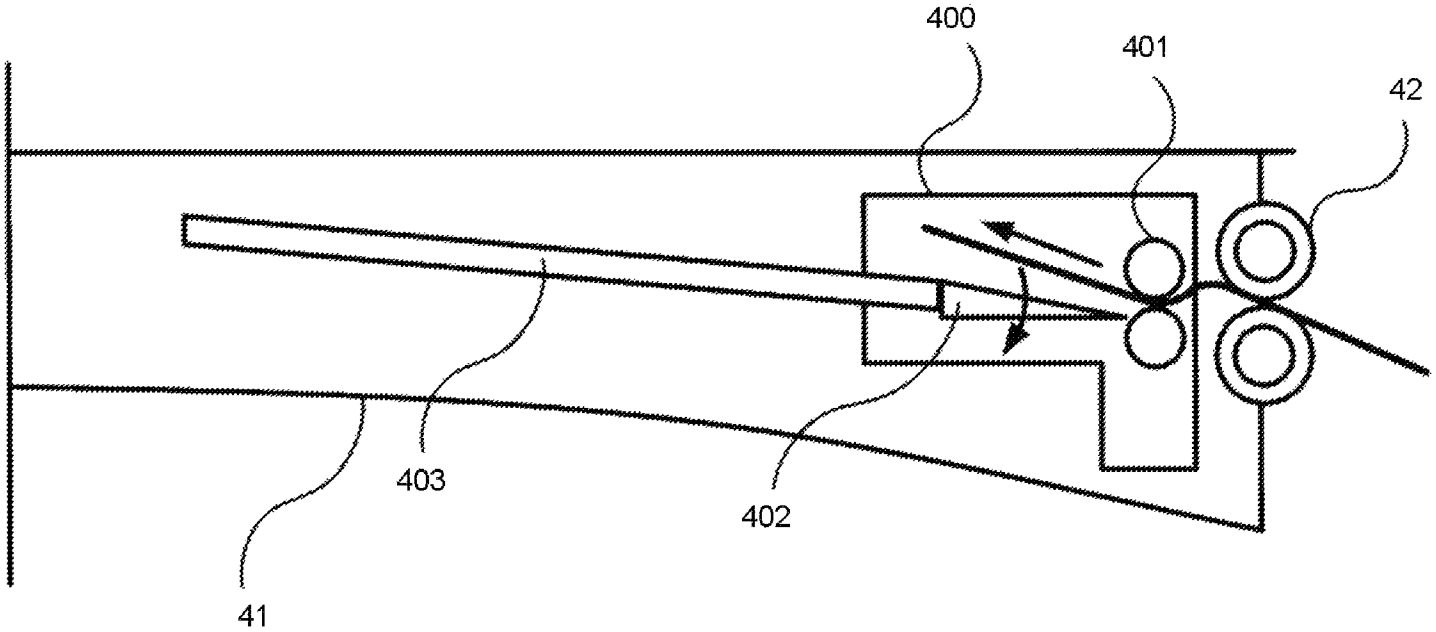
FIG. 5 is a diagram illustrating a state of the separator when a color erasing mode is selected with the operation section shown in FIG. 3.

The paper discharge tray with separator 400 comprises a sheet conveyance roller 401, a separator 402, and an image-erased sheet discharge tray 403. The paper discharge tray with separator 400 is arranged in the paper discharge section 40 formed in a recess part at the upper portion of a main body of the MFP 1. The separator 402 is disposed between the image-erased sheet discharge tray 403 and the sheet conveyance roller 401. When the MFP 1 is carrying out an image forming processing, the separator 402 is positioned at a first position inclined downward relative to the image-erased sheet discharge tray 403 as shown in FIG. 4 and guides the sheet subjected to the image forming processing to the paper discharge tray 41. On the other hand, when the MFP 1 is carrying out an image erasing processing, the separator 402 is positioned at a second position which is at the same level as the image-erased sheet discharge tray 403 as shown in FIG. 5 and guides the sheet subjected to the image erasing processing to the image-erased sheet discharge tray 403.

Figure 2:
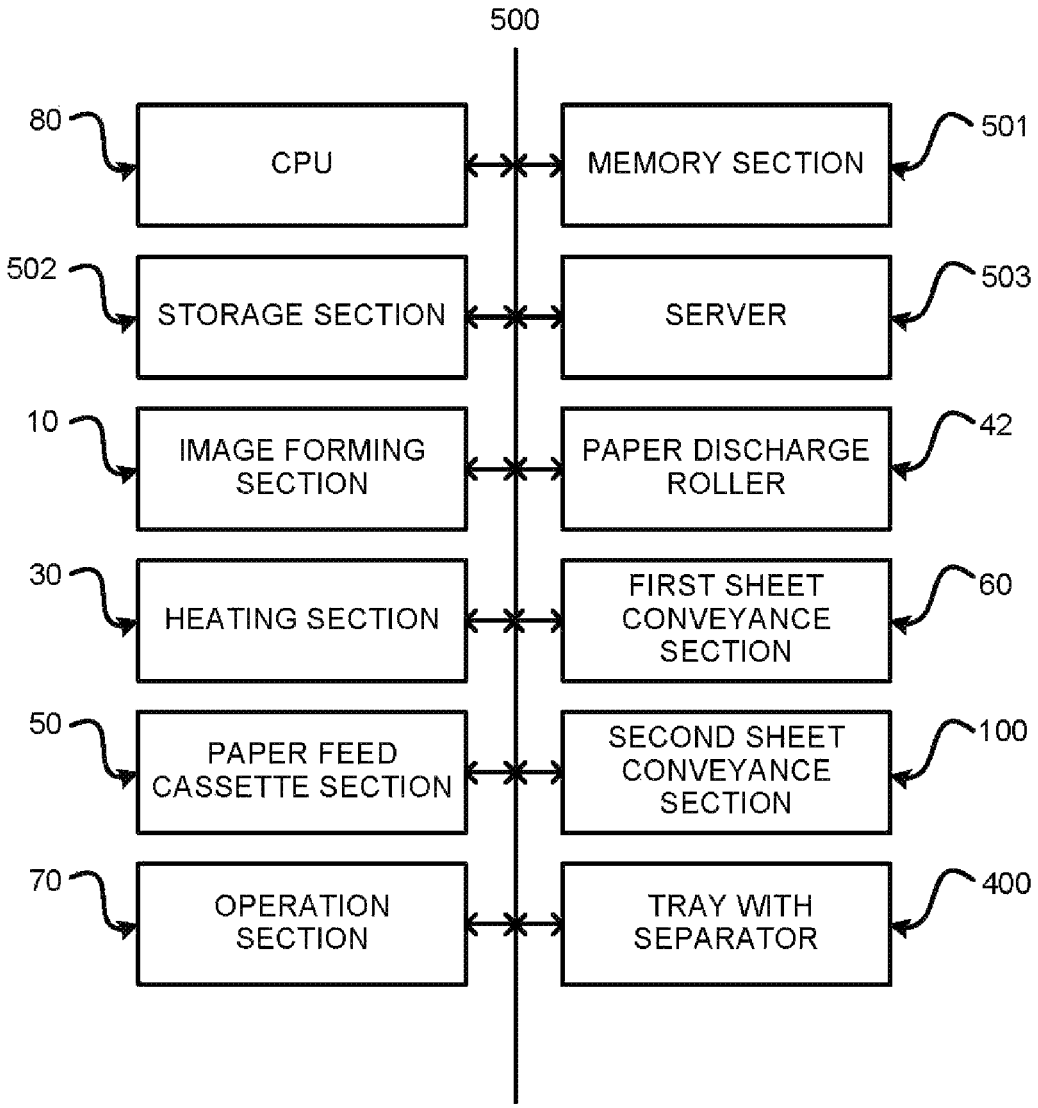
FIG. 2 is a control block diagram illustrating a configuration of the image forming apparatus according to the first embodiment.

FIG. 2 is a control block diagram illustrating the configuration of the MFP 1. In FIG. 2, a CPU 80 for controlling the whole MFP 1, a memory section 501 for storing image data of an original and the like, a storage section 502, a server 503, the image forming section 10, the fixing section 30, the paper discharge roller 42, the paper feed cassette section 50, the first sheet conveyance section 60, the operation section 70, the second sheet conveyance section 100, and the paper discharge tray with separator 400 are connected through a bus line 500.

The CPU 80 executes a given processing based on a program stored in the memory section 501 or the storage section 502, and manages the image forming operation and the image erasing processing operation. The memory section 501 may be, for example, a RAM (Random Access Memory), a ROM (Read Only Memory), a DRAM, a SRAM (Static Random Access Memory), a VRAM (Vieo Ram), or a flash memory, and has a function of storing various kinds of information and programs used in the MFP1.

Figure 3:
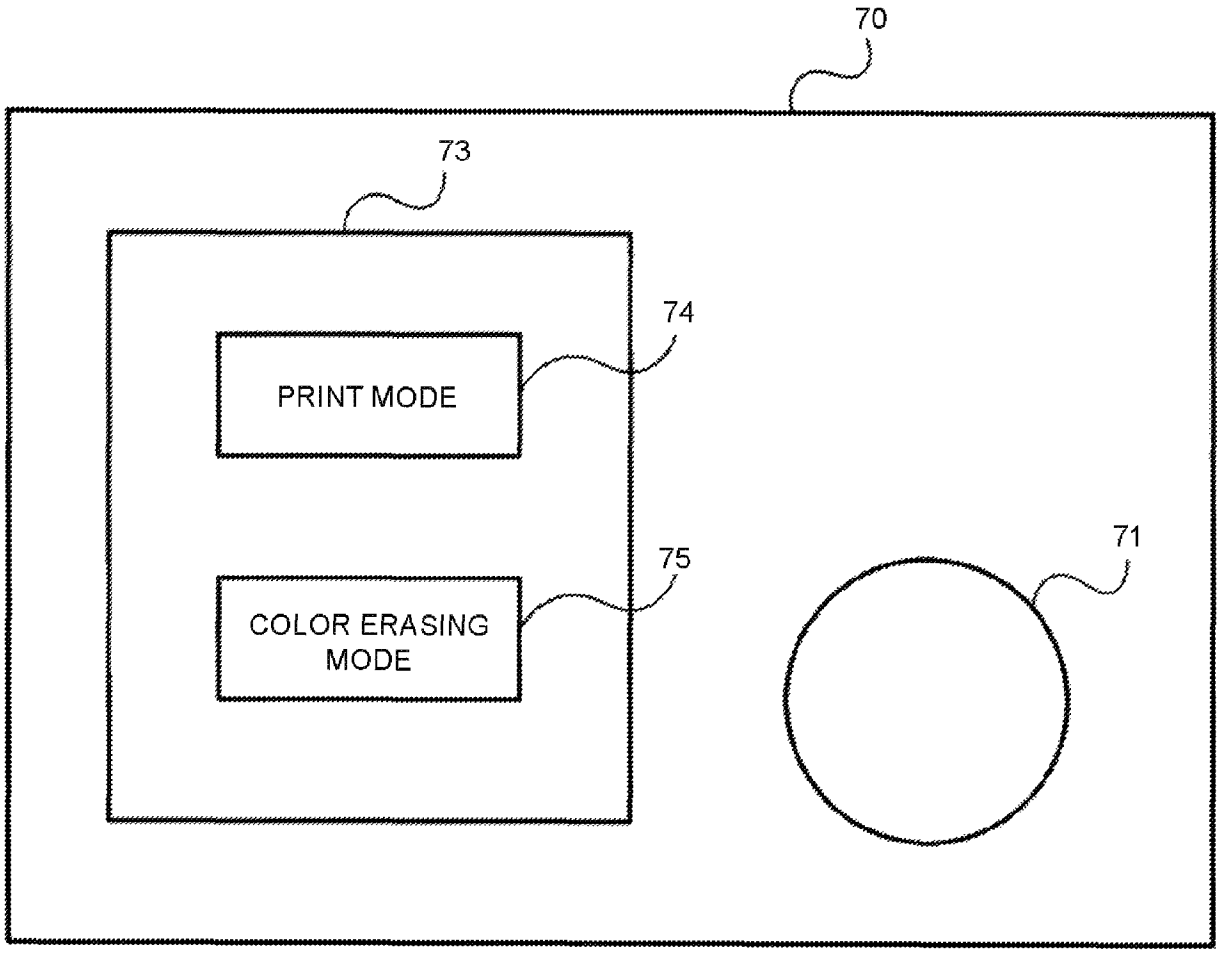
FIG. 3 is a diagram illustrating example of an interface displayed on an operation section of the image forming apparatus according to the first embodiment.

FIG. 3 is a diagram illustrating an example of an interface displayed on the operation section 70 with which an image forming mode can be selected.

The operation section 70 comprises a start switch 71, a monitor 73, a print mode selection switch 74, and an erasing mode selection switch 75.

The CPU 80 controls and drives the image forming section 10, the fixing section 30, the paper discharge roller 42, the paper feed cassette section 50, the first sheet conveyance section 60, the operation section 70, the second sheet conveyance section 100, and the paper discharge tray with separator 400.

If a user selects a print mode by pressing the print mode selection switch 74 displayed on the operation section 70, the CPU 80 sets the print mode as its operation mode.

If the print mode is set, the paper feed roller 52 conveys the sheet in the paper feed cassette section 50 to the first sheet conveyance path 63, and stops the sheet temporarily at the register roller 62. Then the register roller 62 is driven at a given timing, and the sheet is conveyed to the transfer position T.

In the image forming section 10, the toner image formed on the photoconductive drum 13 is transferred to a sheet, and the sheet is conveyed to the fixing section 30. The fixing section 30 heats and presses the sheet at the fixing temperature T2 to fix the toner image on the sheet. The fixed sheet is discharged to the paper discharge tray 41 by the paper discharge roller 42.

The laser exposure device 11 irradiates the photoconductive drum 13 with a laser. The laser exposure device 11 irradiates the surface of the photoconductive drum 13 with a laser to form an electrostatic latent image corresponding to the image of the original on the surface of the photoconductive drum 13. Then, the developer 12 develops the electrostatic latent image into a toner image, and the transfer roller 16 transfers the toner image formed on the photoconductive drum 13 to the sheet.

The fixing section 30 heats and presses the sheet transferred with a toner image to fix the toner image on the sheet.

The paper discharge roller 42 conveys the sheet heated in the fixing section 30.

FIG. 4 is a diagram illustrating an operation of the paper discharge tray with separator 400 when the image forming processing is carried out. The sheet conveyance roller 401 conveys the sheet conveyed from the paper discharge roller 42, and the sheet conveyed by the sheet conveyance roller 401 is guided to the paper discharge tray 41 as the separator 402 is positioned at the first position.

Next, an operation of the MFP 1 when the erasing mode is selected is illustrated.

The CPU 80 controls and drives the image forming section 10, the fixing section 30, the paper discharge roller 42, the paper feed cassette section 50, the first sheet conveyance section 60, the operation section 70, the second sheet conveyance section 100, and the paper discharge tray with separator 400.

If a user selected the erasing mode by pressing the erasing mode selection switch 75 displayed on the operation section 70, the CPU 80 sets the erasing mode as its operation mode.

If the erasing mode is set, in the second sheet conveyance section 100, the sheet passes through the second sheet conveyance path 103. The second sheet conveyance path 103 merges with the first sheet conveyance path 63 at a merging point located between the transfer position T and the fixing section 30. The erasing sheet conveyance roller 102 guides the sheet stacked on the image-erasable sheet stacking tray 101 to the second sheet conveyance path 103, and conveys the sheet to the merging point. By providing the second sheet conveyance section 100 in the MFP 1, the sheet on which an image is to be erased is conveyed to the fixing section 30 without passing through the transfer position T.

Next, the fixing section 30 heats the sheet conveyed by the erasing sheet conveyance roller 102 at the erasing temperature (T1), and erases the color erasable toner image formed on the sheet.

When the image erasing processing is carried out, the sheet conveying of the image forming section 10 is stopped. When the sheet passes through the transfer position T, it is necessary to drive the photoconductive drum 13 and the transfer roller 16; however, since the sheet does not pass through the transfer position T during the image erasing processing, the sheet conveying of the image forming section 10 can be stopped.

FIG. 5 is a diagram illustrating an operation of the paper discharge tray with separator 400 carrying out the image erasing processing. The paper discharge roller 42 conveys the sheet subjected to the image erasing processing to the sheet conveyance roller 401, and the sheet conveyance roller 401 conveys the sheet conveyed by the paper discharge roller 42 towards the paper discharge tray 41. When the MFP 1 carries out the image erasing processing, the separator 402 is positioned at the second position as shown in FIG. 5, and the sheet is guided to the image-erased sheet discharge tray 403. By providing the paper discharge tray with separator 400 in the MFP 1, the sheet formed with an image can be separated from the sheet subjected to the image erasing processing.

(Second Embodiment)

Figure 6:
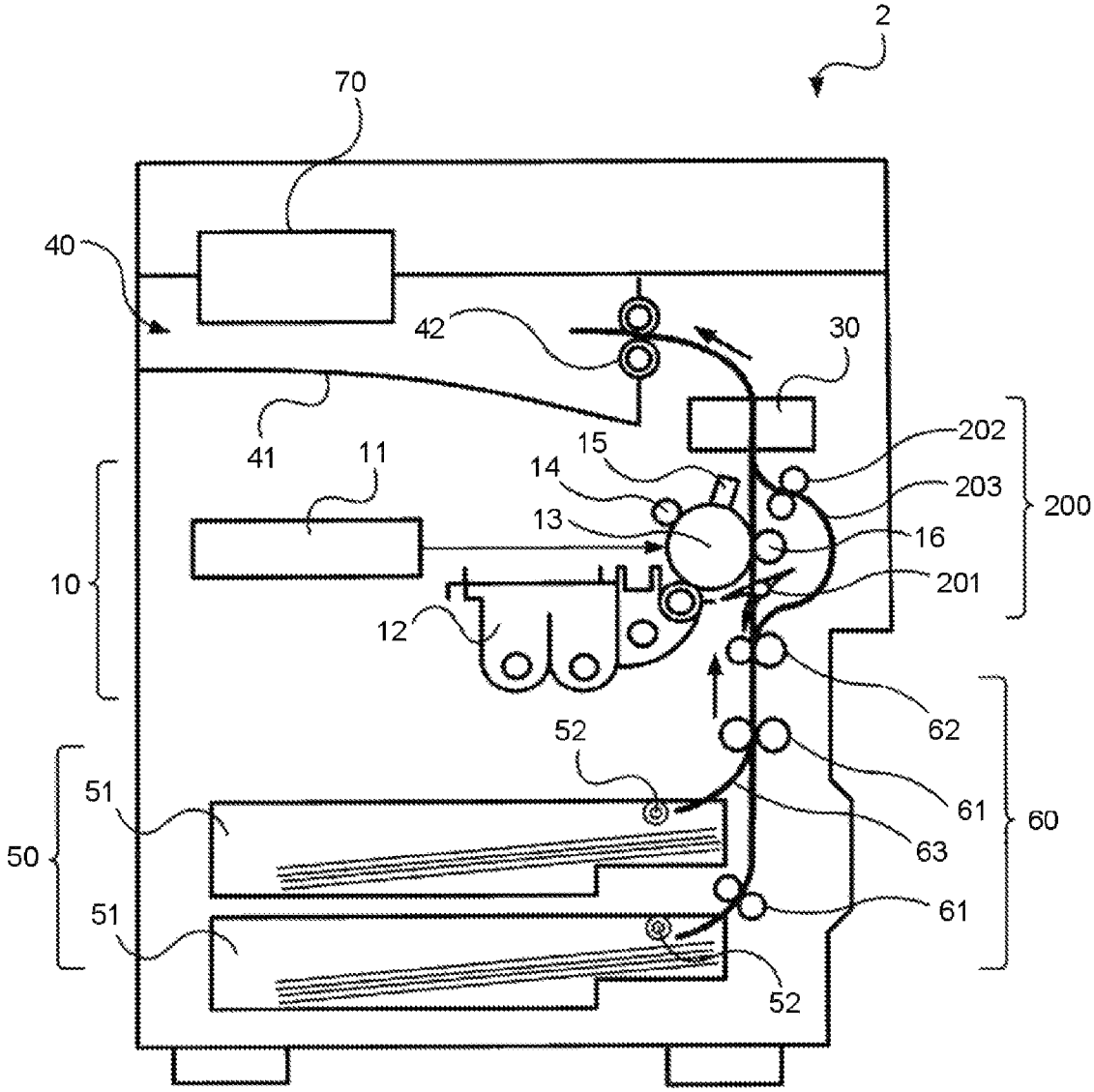
FIG. 6 is a diagram illustrating a schematic configuration of an image forming apparatus according to a second embodiment.

A second embodiment is described with reference to FIG. 6. The components having the same functions as those of the first embodiment shown in FIG. 1 are assigned with the same reference numbers and therefore are not described repeatedly. FIG. 6 is a diagram illustrating a configuration of an image forming apparatus 2 (MFP 2) according to the second embodiment.

MFP 2 can store a sheet to be subjected to image erasing processing in the paper feed cassette section 50, and discharge the sheet subjected to the image erasing processing at the fixing section 30 to the paper discharge section 40.

The MFP 2 comprises the image forming section 10, the fixing section 30, the paper discharge section 40, the paper feed cassette section 50, the first sheet conveyance section 60, the operation section 70, and a third sheet conveyance section 200.

The third sheet conveyance section 200 comprises a separator 201, an image-erasable sheet conveyance roller 202, and a third sheet conveyance path 203. The third sheet conveyance path 203 bifurcates from the first sheet conveyance path 63 at a bifurcating point located between the register roller 62 and the transfer position T, and merges with the first sheet conveyance path 63 at a merging point located between the fixing section 30 and the transfer position T. The separator 201 is located between the bifurcating point of the third sheet conveyance path 203 and the transfer position T. In an image forming processing, by being positioned at a first position, the separator 201 guides a sheet (a first medium) conveyed by the register roller 62 to the transfer position T. Further, in the image erasing processing, by being positioned at a second position, the separator 201 guides a sheet (a second medium) conveyed from the register roller 62 to the third sheet conveyance path 203. The image-erasable sheet conveyance roller 202 conveys the sheet guided to the third sheet conveyance path 203 to the fixing section 30. By conveying the sheet in the third sheet conveyance path 203, the sheet does not pass through the transfer position T. Since the sheet does not pass through the transfer position T, the sheet conveying of the image forming section 10 can be stopped.

Figure 7:
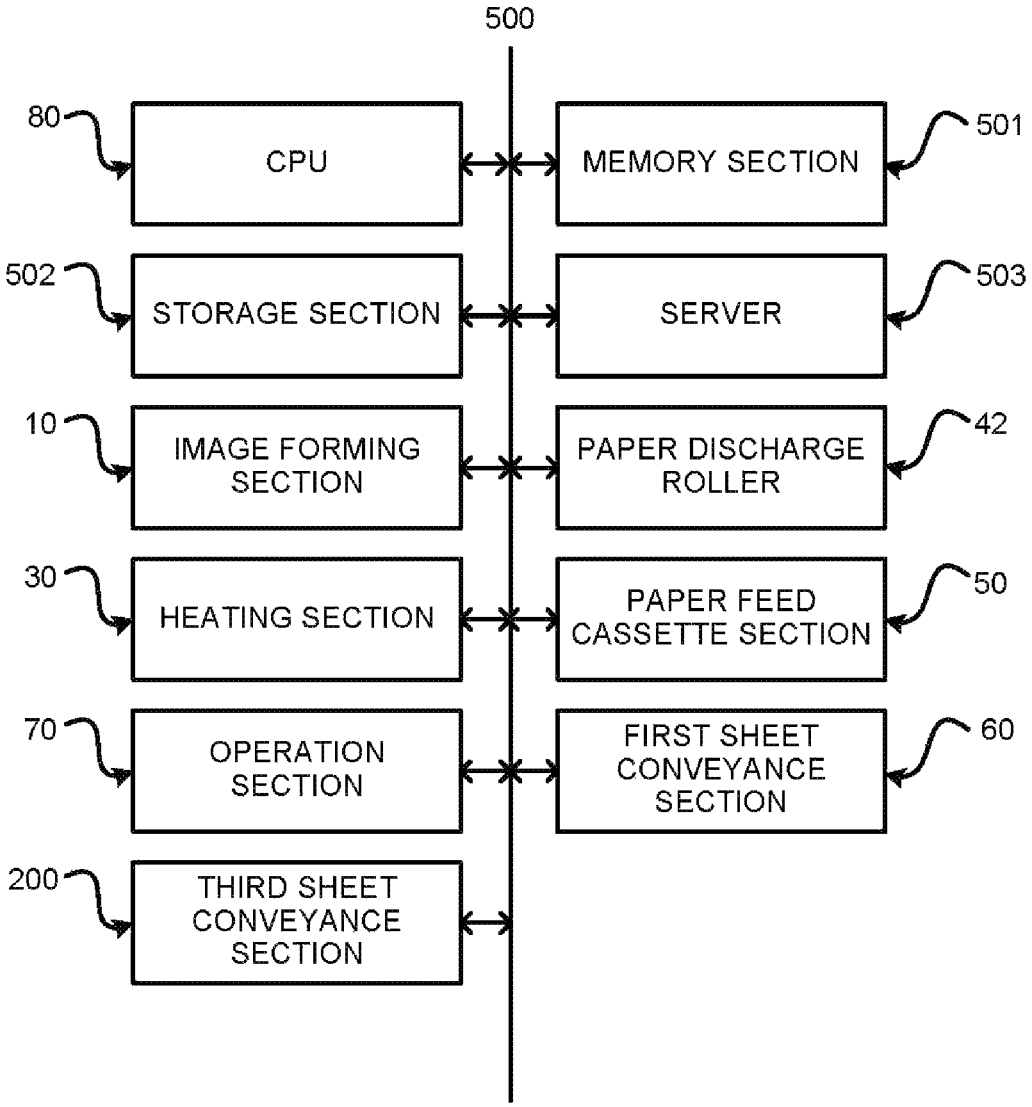
FIG. 7 is a control block diagram illustrating a configuration of the image forming apparatus according to the second embodiment.

FIG. 7 is a control block diagram illustrating the configuration of the MFP 2. In FIG. 7, the CPU 80 for controlling the whole MFP 2, the memory section 501, the storage section 502, the server 503, the image forming section 10, the fixing section 30, the paper discharge roller 42, the paper feed cassette section 50, the first sheet conveyance section 60, the operation section 70, and the third sheet conveyance section 200 are connected through the bus line 500.

Next, the operation of the MFP 2 when carrying out the image erasing processing is described. The operation of the MFP 2 when carrying out the image forming processing is the same as that of the MFP 1, and is not described repeatedly.

The CPU 80 controls and drives the image forming section 10, the fixing section 30, the paper discharge roller 42, the paper feed cassette section 50, the first sheet conveyance section 60, the operation section 70, and the third sheet conveyance section 200.

If a user selects the erasing mode by pressing the erasing mode selection switch 75 displayed on the operation section 70, the CPU 80 sets the erasing mode as its operation mode.

First, the paper feed roller 52 conveys a sheet from the paper feed cassette 51 to the first sheet conveyance path 63, and the sheet conveyance roller 61 conveys the sheet conveyed by the paper feed roller 52 to the register rollers 62. Next, the register roller 62 conveys the sheet conveyed by the sheet conveyance roller 61 to the transfer position T or the third sheet conveyance path 203.

In the third sheet conveyance section 200, as the separator 201 is positioned at the second position, the sheet to be subjected to the image erasing processing is guided to the third sheet conveyance path 203. Thereby, in the image erasing processing, a sheet does not pass through the transfer position T.

In the image erasing processing, the sheet conveying of the image forming section 10 is stopped. When the sheet passes through the transfer position T, it is necessary to drive the photoconductive drum 13 and the transfer roller 16; however, since the sheet does not pass through the transfer position T in the image erasing processing, the sheet conveying of the image forming section 10 can be stopped.

The paper discharge roller 42 conveys the sheet subjected to the image erasing processing to the paper discharge section 40.

(Third Embodiment)

Figure 8:
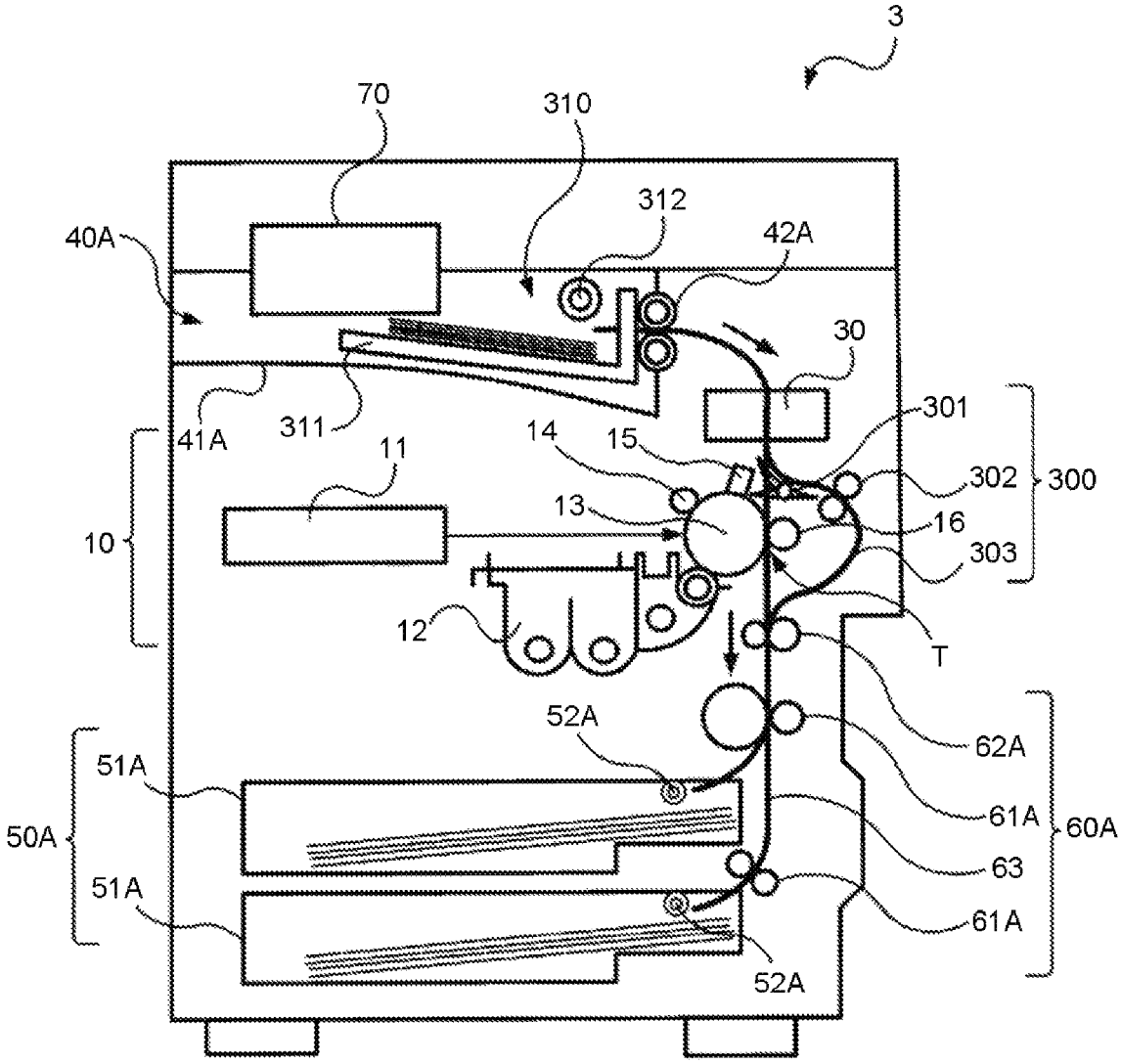
FIG. 8 is a diagram illustrating a schematic configuration of an image forming apparatus according to a third embodiment.

A third embodiment is described with reference to FIG. 8. Further, the components having the same functions as those in the first embodiment are assigned with the same reference numbers and therefore are not described repeatedly. FIG. 8 is a diagram illustrating a configuration of a MFP 3 according to the third embodiment.

The MFP 3 comprises the image forming section 10, the fixing section 30, a paper discharge and sheet stacking section 40A, a paper feed cassette and sheet discharge section 50A, a first sheet conveyance section 60A, the operation section 70, a fourth sheet conveyance section 300, and an image-erasing sheet feed section 310. The paper discharge and sheet stacking section 40A comprises a paper discharge tray 41A and a paper discharge roller 42A. The paper feed cassette and sheet discharge section 50A comprises a paper feed and discharge cassette 51A and a paper feed and discharge roller 52A. The first sheet conveyance section 60A comprises a sheet conveyance roller 61A, a register roller 62A, and the first sheet conveyance path 63.

The paper discharge roller 42A, the paper feed and discharge roller 52A, the sheet conveyance roller 61A, and the register roller 62A are rotated forward in an image forming processing, and are rotated reversely in an image erasing processing.

The conveying direction of a sheet (a second medium) when the MFP 3 is carrying out the image erasing processing is opposite to that of a sheet (a first medium) when the MFP 3 is carrying out the image forming processing. When the MFP 3 is carrying out the image erasing processing, the sheet to be subjected to the image erasing processing is conveyed from the image-erasing sheet feed section 310 arranged in the paper discharge and sheet stacking section 40A to the fixing section 30, and discharged to the paper feed cassette and sheet discharge section 50A after being subjected to the image erasing processing in the fixing section 30.

The image-erasing sheet feed section 310 comprises an image-erasing sheet feed tray 311 and an image-erasing sheet feed roller 312. A user puts a sheet to be subjected to the image erasing processing in the image-erasing sheet feed tray 311. The erasing sheet feed roller 312 conveys the sheet put in the image-erasing sheet feed tray 311 to the first sheet conveyance path 63.

The fourth sheet conveyance section 300 comprises a separator 301, an image-erased sheet conveyance roller 302, and a fourth sheet conveyance path 303. The fourth sheet conveyance path 303 bifurcates from the first sheet conveyance path 63 at a bifurcating point located between the fixing section 30 and the transfer position T, and merges with the first sheet conveyance path 63 at a merging point located between the transfer position T and the register roller 62A. By providing a fourth sheet conveyance path 303 in the MFP 3, the sheet does not pass through the transfer position T during the image erasing processing. The separator 301 is positioned between the bifurcating point and the merging point of the fourth sheet conveyance path 303. By being positioned at a first position, the separator 301 guides the sheet conveyed from the transfer position T to the fixing section 30. By being positioned at a second position, the separator 301 guides the sheet heated in the fixing section 30 to the fourth sheet conveyance path 303. The image-erased sheet conveyance roller 302 conveys the sheet guided to the fourth sheet conveyance path 303 towards the register roller 62. By providing the fourth sheet conveyance section in the MFP 3, the sheet conveying of the image forming section 10 can be stopped during the image erasing processing since the sheet does not pass through the transfer position T during the image erasing processing.

Figure 9:
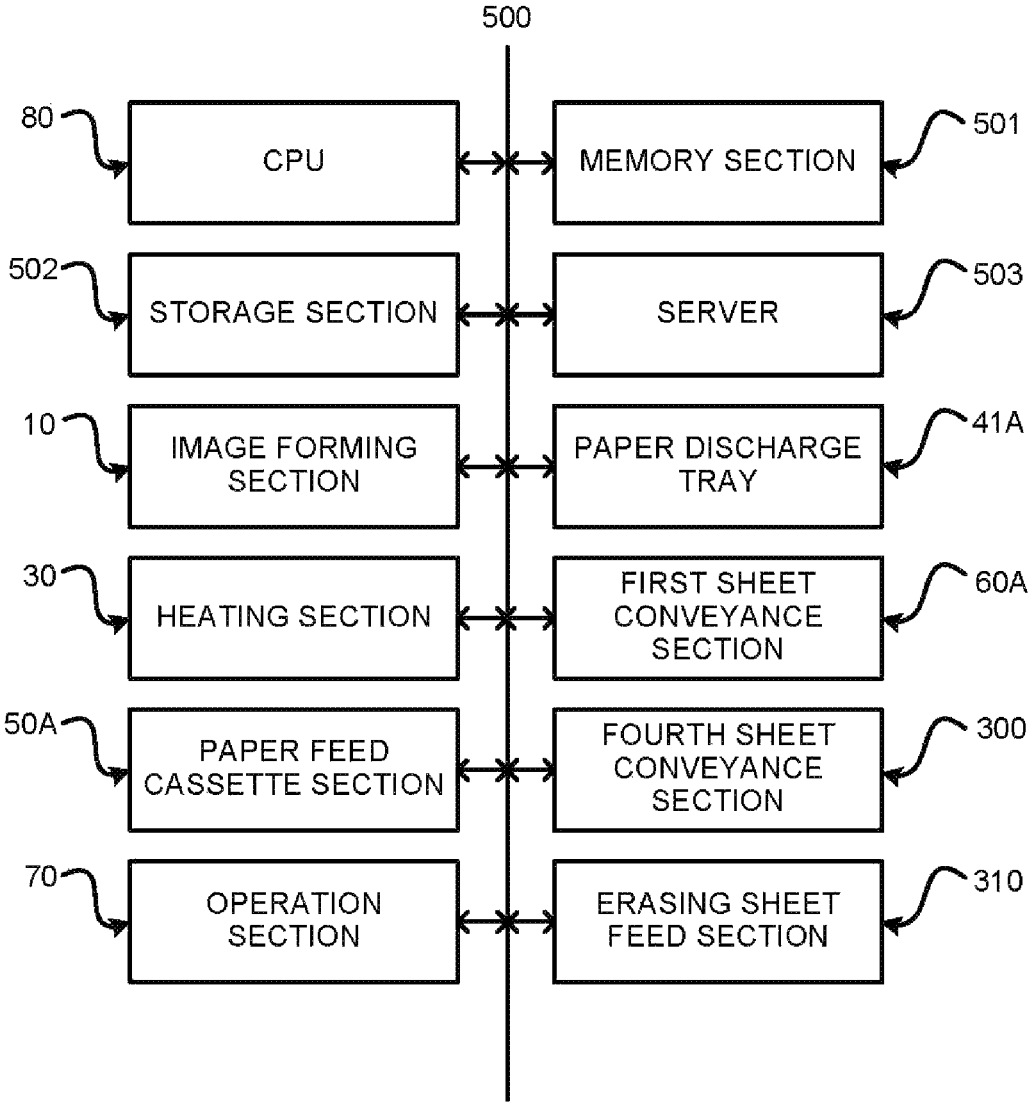
FIG. 9 is a control block diagram illustrating a configuration of the image forming apparatus according to the third embodiment.

FIG. 9 is a control block diagram illustrating a configuration of the MFP 3.

In FIG. 9, the CPU 80 for controlling the whole MFP 3, the memory section 501, the storage section 502, the server 503, the image forming section 10, the fixing section 30, the paper discharge roller 42A, the paper feed cassette and sheet discharge section 50A, the first sheet conveyance section 60A, the operation section 70, the fourth sheet conveyance section 300, and the image-erasing sheet feed section 310 are connected through the bus line 500.

Next, the operation of the MFP 3 when carrying out the image erasing processing is described. The operation of the MFP 3 when carrying out the image forming processing is the same as that of the MFP 2, and is not described repeatedly.

The CPU 80 controls and drives the image forming section 10, the fixing section 30, the paper discharge roller 42A, the paper feed cassette and sheet discharge section 50A, the first sheet conveyance section 60A, the operation section 70, the fourth sheet conveyance section 300, and the image-erasing sheet feed section 310.

The image-erasing sheet feed roller 312 conveys the sheet put in the image-erasing sheet feed tray 311 to the paper discharge roller 42A, and the paper discharge roller 42A conveys the sheet conveyed by the image-erasing sheet feed roller 312 to the fixing section 30.

The fixing section 30 erases the erasable toner image formed on the sheet.

The operation of the image forming section 10 is stopped in the image erasing processing. As stated above, by providing the fourth sheet conveyance path 303 in the MFP 3, the sheet does not pass through the transfer position T during the image erasing processing. In this way, the operation of the image forming section 10 can be stopped during the image erasing processing.

In the fourth sheet conveyance section 300, by being positioned at the second position, the separator 301 guides the sheet heated in the fixing section 30 to the fourth sheet conveyance path 303. The image-erased sheet conveyance roller 302 conveys the sheet conveyed by the fourth sheet conveyance section to the register roller 62A, and the register roller 62A conveys the sheet conveyed by the image-erased sheet conveyance roller 302 to the sheet conveyance roller 61A.

The sheet conveyance roller 61A conveys the sheet conveyed by the register roller 62A to the paper feed and discharge cassette 51A. At this time, the sheet conveyance roller 61A rotates in a direction opposite to that in the image forming processing.

(Fourth Embodiment)

A fourth embodiment is described with reference to FIG. 10. Further, the components having the same functions as those in the first embodiment are assigned with the same reference numbers and therefore are not described repeatedly.

Figure 10:
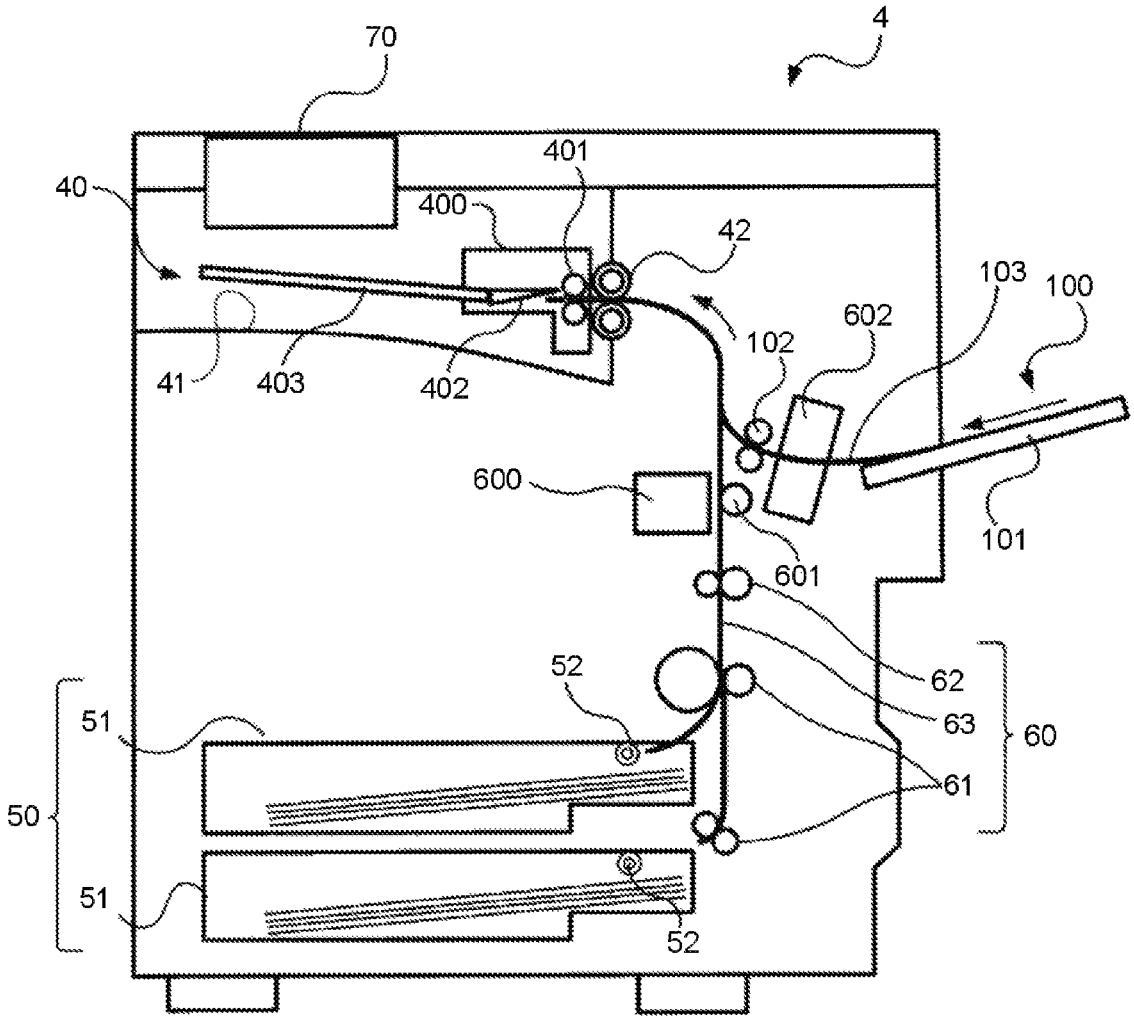
FIG. 10 is a diagram illustrating a schematic configuration of an image forming apparatus according to a fourth embodiment.

The present embodiment shown in FIG. 10 is a modification of the first embodiment, in which an inkjet-type image forming section 600 is used instead of the electrophotographic type image forming section 10. The image forming section 600 forms an image on a sheet (a first medium) with a decolorizable ink or a non-decolorizable ink. Further, in the present embodiment, a platen 601 is used instead of the transfer roller 16 shown in FIG. 1. Moreover, a heating section 602 is used instead of the fixing section 30 shown in FIG. 1. The fixing section 30 has a fixing function of fixing toner on a sheet (a first medium) as well as an erasing function of erasing an image formed on a sheet (a second medium) with a decolorizable toner. On the other hand, the heating section 602 has an image erasing function. Further, the fixing section 30 is disposed at the upstream side with respect to the paper discharge roller 42 in the sheet conveyance direction and the downstream side with respect to the merging point of the first sheet conveyance path 63 and the second sheet conveyance path 103 in the sheet conveyance direction. On the other hand, the heating section 600 is disposed along the second sheet conveyance path 103.

(Fifth Embodiment)

Figure 11:
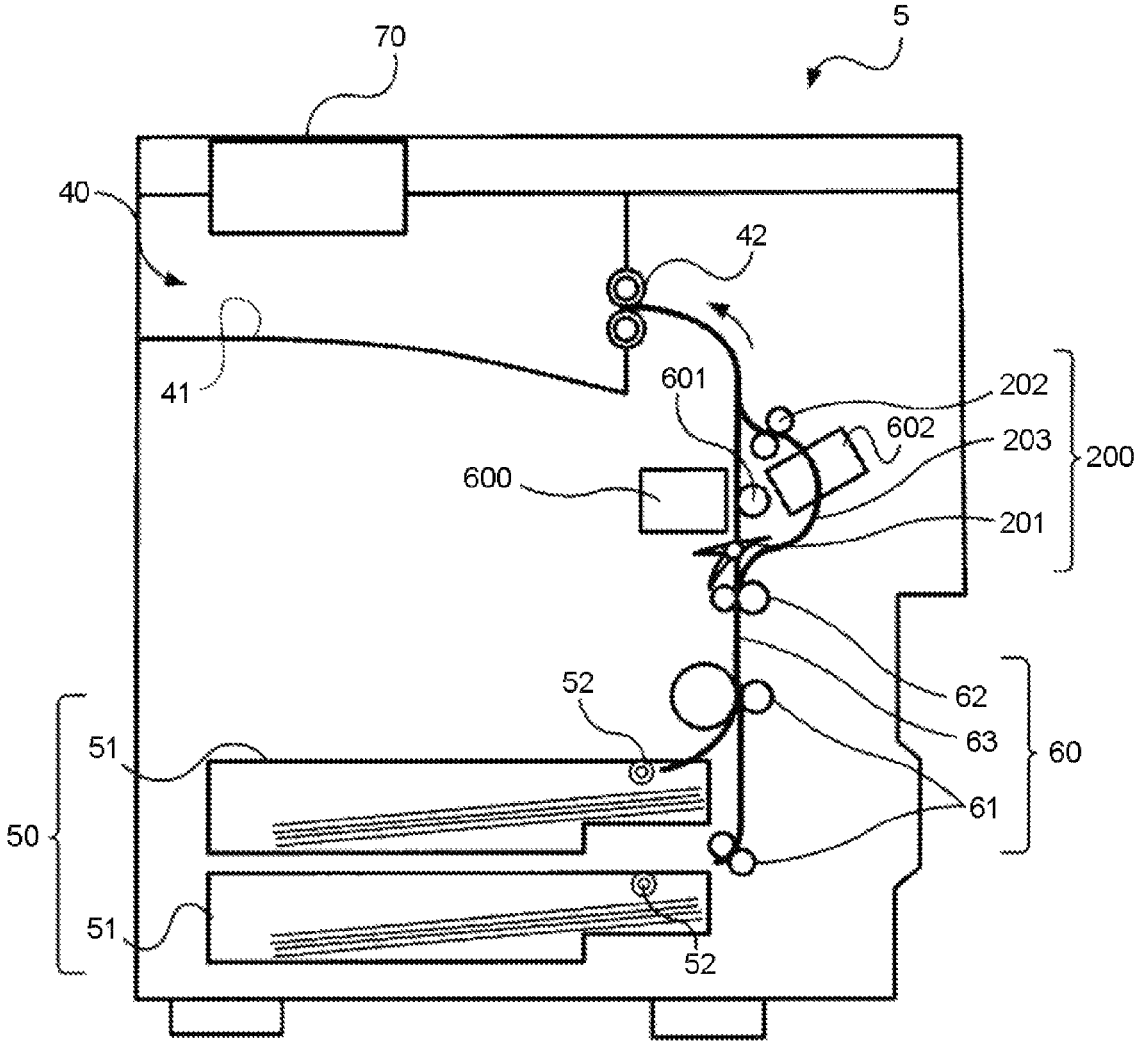
FIG. 11 is a diagram illustrating a schematic configuration of an image forming apparatus according to a fifth embodiment.

The fifth embodiment is described with reference to FIG. 11. Further, the components having the same functions as those in the second embodiment are assigned with the same reference numbers and therefore are not described repeatedly.

In the fifth embodiment, an image forming section 606 is used instead of the image forming section 10 shown in FIG. 6. The image forming section 606 is an inkjet-type image forming section which can form an image on a sheet (a first medium) with a decolorizable ink or a non-decolorizable ink. Further, a platen 601 is used instead of the transfer roller 16 shown in FIG. 6. Moreover, a image erasing section 602 is used instead of the fixing section 30 shown in FIG. 6. The fixing section 30 has a fixing function of fixing toner on a sheet (a first medium) as well as an erasing function of erasing an image formed on a sheet (a second medium) with a decolorizable toner. on the other hand, the image erasing section 602 only has an image erasing function. Further, the fixing section 30 is disposed at the upstream side with respect to the paper discharge roller 42 in the sheet conveyance direction and the downstream side with respect to the merging point of the first sheet conveyance path 63 and the second sheet conveyance path 103 in the sheet conveyance direction. On the other hand, the image erasing section 602 is disposed along the second sheet conveyance path 203.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a medium holder configured to store a first medium;

an image forming unit configured to form an image on the first medium at an image forming position;

a fixing unit configured to fix the image formed on the first medium by heating the first medium at a first temperature;

a conveying unit configured to convey the first medium to the fixing unit through a first path extending from the medium holder to the fixing unit through the image forming position and convey a second medium to the fixing unit through a second path that branches off from the first path at a position between the medium holder and the image forming unit and merges with the first path at a position between the image forming position and the fixing unit; and a control unit configured to control the fixing unit to be at a second temperature that is higher than the first temperature, when the control unit determines that the conveying unit is conveying the second medium to the fixing unit through the second path.

2. The image forming apparatus according to claim 1, wherein the control unit is further configured to control the conveying unit to stop conveying the first medium through the image forming position when the control unit determines that the conveying unit is conveying the second medium to the fixing unit through the second path.

3. The image forming apparatus according to claim 2, wherein the control unit is further configured to control the image forming unit to stop forming the image on the first medium when the control unit determines that the conveying unit is conveying the second medium to the fixing unit through the second path.

4. The image forming apparatus according to claim 1, further comprising:

a first medium holder;

a second medium holder; and a guiding unit configured to guide a medium conveyed from the fixing unit to the first medium holder and the second medium holder, wherein the conveying unit is further configured to convey the first medium and the second medium to the guiding unit, and the control unit is further configured to control the guiding unit to guide the first medium to the first medium holder and the second medium to the second medium holder.

5. The image forming apparatus according to claim 4, further comprising:

a third medium holder that is connected to the second path and on which the second medium is placed, wherein the conveying unit is further configured to convey the second medium on the third medium holder to the fixing unit through the second path.

6. The image forming apparatus according to claim 1, wherein the second path is shorter than the first path.

7. The image forming apparatus according to claim 1, wherein the conveying unit is further configured to convey a medium from the fixing unit to the image forming position and to the second path.

8. The image forming apparatus according to claim 1, wherein the second temperature is a temperature at which a decolorizable recording material is decolorized.

9. A method for operating an image forming apparatus comprising:

a medium holder configured to store a first medium;

an image forming unit configured to form an image on the first medium at an image forming position;

a fixing unit configured to fix the image on the first medium by heating the first medium at a first temperature; and a conveying unit configured to convey the first medium to the fixing unit through a first path extending from the medium holder to the fixing unit through the image forming position and convey a second medium to the fixing unit through a second path that branches off from the first path at a position between the medium holder and the image forming unit and merges with the first path at a position between the image forming position and the fixing unit, the method comprising:

determining whether or not the conveying unit is conveying the second medium to the fixing unit through the second path; and controlling the fixing unit to be at a second temperature that is higher than the first temperature, when the conveying unit is determined to be conveying the second medium to the fixing unit through the second path.

10. The method according to claim 9, further comprising:

controlling the conveying unit to stop conveying the first medium through the image forming position, when the conveying unit is determined to be conveying the second medium to the fixing unit through the second path.

11. The method according to claim 9, further comprising:

controlling the image forming unit to stop forming the image onto the first medium, when the conveying unit is determined to be conveying the second medium to the fixing unit through the second path.

12. The method according to claim 9, wherein the image forming apparatus further comprising:

a first medium holder;

a second medium holder; and a guiding unit configured to guide a medium conveyed from the fixing unit to the first medium holder and the second medium holder, the method further comprising:

controlling the conveying unit to convey the medium from the fixing unit to the guiding unit; and controlling the guiding unit to guide the first medium to the first medium holder and the second medium to the second medium holder.

13. The method according to claim 9, wherein the second path is shorter than the first path.

14. The method according to claim 9, wherein the second temperature is a temperature at which a decolorizable recording material is decolorized.

15. An image forming apparatus, comprising:

an image forming unit configured to form an image on a first medium at an image forming position;

a fixing unit configured to fix the image formed on the first medium by heating the first medium at a first temperature;

a first medium holder;

a second medium holder;

a guiding unit configured to guide a medium from the fixing unit to the first medium holder and the second medium holder; and a conveying unit configured to convey the first medium to the fixing unit through a first path extending from the image forming position to the fixing unit, convey a second medium to the fixing unit through a second path that merges with the first path at a position between the image forming position and the fixing unit, and convey the first medium and the second medium to the guiding unit;

a control unit configured to control the fixing unit to be a at second temperature that is higher than the first temperature, when the control unit determines that the conveying unit is conveying the second medium to the fixing unit through the second path, and control the guiding unit to guide the first medium to the first medium holder and the second medium to the second medium holder.

16. The image forming apparatus according to claim 15, further comprising:

a third medium holder that is connected to the second path and on which the second medium is placed, wherein the conveying unit is further configured to convey the second medium on the third medium holder to the fixing unit through the second path.

* * * * *